US009188409B2

(12) United States Patent
Sagebiel et al.

(10) Patent No.: US 9,188,409 B2
(45) Date of Patent: Nov. 17, 2015

(54) MULTI-ROW PANEL ACTIVE BLAST SYSTEM

(71) Applicant: TenCate Advanced Armour USA, INC., Newark, OH (US)

(72) Inventors: Erick James Sagebiel, Colorado Springs, CO (US); Andrew Roger Hansen, Thousand Oaks, CA (US); Robert Schwarz, New York, NY (US); Joergen Leir Svane, Felsted (DK); Josef Stefan Dobriski, Morgan Hill, CA (US)

(73) Assignee: Tencate Advanced Armour USA, Inc., Newark, OH (US)

( * ) Notice: Subject to any disclaimer, the term of this patent is extended or adjusted under 35 U.S.C. 154(b) by 48 days.

(21) Appl. No.: 14/084,846

(22) Filed: Nov. 20, 2013

(65) Prior Publication Data

US 2014/0224110 A1 Aug. 14, 2014

Related U.S. Application Data

(60) Provisional application No. 61/757,296, filed on Jan. 28, 2013, provisional application No. 61/796,811, filed on Nov. 20, 2012.

(51) Int. Cl.
*F41H 5/007* (2006.01)
*F41H 7/00* (2006.01)
(Continued)

(52) U.S. Cl.
CPC ..... *F41H 5/007* (2013.01); *F41H 5/013* (2013.01); *F41H 7/00* (2013.01); *F41H 7/04* (2013.01); *F41H 7/044* (2013.01); *Y10T 29/49826* (2015.01)

(58) Field of Classification Search
CPC ..... F41H 5/007; F41H 7/00
USPC ..... 89/36.17, 1.11; 102/336
See application file for complete search history.

(56) References Cited

U.S. PATENT DOCUMENTS 3,893,368 A 7/1975 Wales, Jr.
7,387,060 B1 * 6/2008 Sanford ..... 89/1.11
(Continued)

FOREIGN PATENT DOCUMENTS

DE 3931895 A1 12/1994
DE 4226897 C1 1/1998
(Continued)

OTHER PUBLICATIONS

International Patent Application No. PCT/US2013/070919, Invitation to Pay Additional Fees and Where Applicable, Protest Fee and Partial Search Report dated Sep. 2, 2014.
(Continued)

*Primary Examiner* — Reginald Tillman, Jr.
(74) *Attorney, Agent, or Firm* — Kilpatrick Townsend & Stockton LLP; Dean W. Russell, Esq.; James E. Golladay, Esq.

(57) ABSTRACT

A countermeasure system is provided including a frame and two or more rows of countermeasures disposed on the frame. Each row of the countermeasures may be configured to be initiated substantially simultaneously along the length of the row. Additional countermeasure systems may include elongated explosive charges and or masses disposed along the length of the rows. The frame may include two or more ridges on a side opposite to the two or more rows of countermeasures, the ridges being configured to engage with corresponding ridges on a vehicle when the countermeasure panel is mounted to the vehicle.

22 Claims, 11 Drawing Sheets

(51) Int. Cl.
*F41H 5/013* (2006.01)
*F41H 7/04* (2006.01)

(56) References Cited

U.S. PATENT DOCUMENTS

| | | | | |
|---|---|---|---|---|
| 8,095,269 | B2 * | 1/2012 | Pruett et al. | 701/39 |
| 8,739,676 | B2 * | 6/2014 | Ames | 89/36.08 |
| 8,881,636 | B2 * | 11/2014 | Hyde et al. | 89/1.11 |
| 2005/0230176 | A1 * | 10/2005 | Wang | 180/282 |
| 2006/0225566 | A1 * | 10/2006 | Lloyd | 89/36.17 |
| 2012/0239247 | A1 * | 9/2012 | Eridon | 701/36 |
| 2013/0092016 | A1 * | 4/2013 | Sales | 89/36.08 |
| 2013/0204496 | A1 * | 8/2013 | Sloman | 701/45 |
| 2013/0328713 | A1 * | 12/2013 | Svane et al. | 342/70 |
| 2014/0076142 | A1 * | 3/2014 | Hyde et al. | 89/36.17 |
| 2014/0214281 | A1 * | 7/2014 | Welker et al. | 701/45 |

FOREIGN PATENT DOCUMENTS

| | | | |
|---|---|---|---|
| EP | 0860678 | A1 | 8/1998 |
| EP | 2362177 | A2 | 8/2011 |
| FR | 2780155 | A1 | 12/1999 |
| FR | 2888921 | A1 | 1/2007 |
| GB | 583674 | A | 12/1946 |
| GB | 2249816 | A | 5/1992 |
| GB | 2480709 | A | 11/2011 |
| WO | 2012047103 | A1 | 4/2012 |
| WO | 2012085138 | A1 | 6/2012 |

OTHER PUBLICATIONS

International Patent Application No. PCT/US2013/070919, International Search Report and Written Opinion dated Dec. 4, 2014.
International Patent Application No. PCT/US2013/070919, International Preliminary Report on Patentability dated Jun. 4, 2015.

* cited by examiner

| Sensor | Quadrant | CMs |
|---|---|---|
| 1 | 1 | 1,2,3 |
| 2 | 2 | 4,5 |
| 3 | 3 | 8,9,10 |
| 4 | 4 | 6,7 |
| 5 | - | - |
| 6 | - | - |
| 7 | - | - |
| 8 | - | - |

MULTI-ROW PANEL ACTIVE BLAST SYSTEM

CROSS REFERENCE TO RELATED APPLICATIONS

This application claims priority under 35 USC 119(e) to U.S. Provisional Patent Application No. 61/757,296, filed Jan. 28, 2013, titled "MULTI ROW PANEL SYSTEM," and U.S. Provisional Patent Application No. 61/796,811, filed Nov. 20, 2012, titled "APPROACHES FOR THE ATTACHMENT OF ACTIVE BLAST MITIGATION SYSTEMS TO VEHICLES," the contents of which are hereby incorporated by reference in their entireties.

BACKGROUND OF THE INVENTION

The present invention generally relates to systems and methods for actively countering forces or threats experienced by an object or person and more particularly, although not exclusively, to systems and methods for actively countering forces or threats experienced by a manned (or unmanned) vehicle upon encountering blast waves of a mine or other explosive device and/or other undesired forces and/or projectiles. The technology may find applicability, for example, in TenCate's ABDS™ active blast countermeasure system, and similar products.

Counteracting the impulse imparted to a vehicle cab by an IED requires transfer of large vertical forces from the countermeasure to the vehicle. Peak forces can be, for example, from 250,000 to over 1,000,000 lbf per location.

Some publications, such as U.S. patent application Ser. No. 13/909,295 by Dobriski et al., entitled "ACTIVE COUNTERMEASURES SYSTEMS AND METHODS," provide descriptions of systems and techniques for creating active countermeasures that are deployable on vehicles. However, there is a limited amount of information available on methods for ensuring that the forces created when using such countermeasures can be adequately managed.

BRIEF SUMMARY OF THE INVENTION

The present subject matter includes systems and methods for, among other objects, mounting active countermeasures to vehicles, and controlling the activation of such countermeasures to counter an explosion and/or a projectile, such as a rocket propelled grenade, missile, bullet, long rod, etc.

According to first aspects of the invention, a countermeasure panel may include a frame, and at least two rows of countermeasures disposed on the frame. In embodiments, each row of the countermeasures may include at least one of an elongated explosive charge disposed along the length of the row or a plurality of segmented explosive charges along the length of the row.

In embodiments, each row of the countermeasures may be configured to be initiated substantially simultaneously along the length of the row.

In embodiments, each row of the countermeasures may be configured to be initiated separately from at least one other row of the countermeasures.

In embodiments, each row of the countermeasures may be configured to fire in a substantially parallel direction to at least one other row of the countermeasures.

In embodiments, each row of the countermeasures may include an elongated mass disposed along the length of the row. In embodiments, each of the elongated masses may be configured to be ejected by at least one of the elongated explosive charges.

In embodiments, each row of the countermeasures may include a plurality of masses disposed along the length of the row. In embodiments, each of the plurality of masses may be configured to be ejected by at least one of the explosive charges.

In embodiments, the frame may include a plate with elongated recesses configured to accommodate an elongated explosive charge or a plurality of segmented explosive charges.

In embodiments, the frame may include a plurality of ridges on a side opposite to the rows of countermeasures. In embodiments, the plurality of ridges may be configured to engage with corresponding ridges on a vehicle when the countermeasure panel is mounted to the vehicle.

According to further aspects of the invention, a countermeasure system configured to be mounted to a vehicle may include a countermeasure configured to fire in an upward direction when mounted to the vehicle; a first sensor device including a plurality of accelerometers configured to detect vertical acceleration of the vehicle; a second sensor device configured to detect projectiles in proximity to the vehicle; and a processor in communication with the first sensor device and the second sensor device. In embodiments, the processor may be configured to initiate the countermeasure based on results of processing signals from the first sensor device, and based on results of processing signals from the second sensor device.

In embodiments, the processor may be further configured to selectively initiate individual countermeasures in different areas of the vehicle based on at least one of the results of processing signals from the first sensor device and the results of processing signals from the second sensor device.

In embodiments, a countermeasure such as described herein may include one or more of a mass ejector and a thruster.

According to further aspects of the invention, a countermeasure system may include a housing; and at least one of a mass ejector and a thruster held by the housing. In embodiments, the housing may include at least one attachment point for fixedly attaching the housing to a vehicle, and a plurality of ridges configured to engage with corresponding ridges on the vehicle when the countermeasure is mounted to the vehicle.

In embodiments, the corresponding ridges may be included on a supplemental armor panel, or may be included on the structure of the vehicle itself. In embodiments, the countermeasure may be integrated on a supplemental armor panel.

In embodiments, one or more first countermeasure may be held by the housing and configured to fire in a first direction, and one or more second countermeasure may be mounted substantially opposite the first countermeasure(s) and configured to fire in a substantially opposite direction to the first direction.

According to further aspects of the invention, a method of mounting a countermeasure to a vehicle may include one or more of attaching the countermeasure to a base structure of the vehicle or a supplemental armor plate of the vehicle using a first attachment mechanism. Embodiments may include supporting the countermeasure in a direction that is substantially opposite of the firing direction of the countermeasure using at least one of (a) a plurality of ridges formed on a mounting face of the countermeasure, the plurality of ridges configured to engage with corresponding ridges on the at least one of a base structure of the vehicle or a supplemental armor plate of the vehicle, (b) a shelf extending from the at least one of a base structure of the vehicle or a supplemental armor plate of the vehicle, and (c) a portion of an underplate of the vehicle that extends outward of the at least one of a base structure of the vehicle or a supplemental armor plate of the vehicle.

In embodiments, supporting the countermeasure may include using the plurality of ridges formed on the mounting face of the countermeasure, and the portion of the underplate that extends outward of the at least one of a base structure of the vehicle or a supplemental armor plate of the vehicle.

In embodiments, supporting the countermeasure may include using the shelf extending from the at least one of a base structure of the vehicle or a supplemental armor plate of the vehicle.

In embodiments, supporting the countermeasure may include engaging the plurality of ridges formed on the mounting face of the countermeasure with corresponding ridges on a supplemental armor plate of the vehicle.

As used herein, attaching a countermeasure "to a vehicle" may include attachment to and/or through one or more of a vehicle base structure, such as a cab, frame or other structural component, or a supplemental armor plate, such as an A-kit armor plate, a B-kit armor plate, a C-kit armor plate, etc.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the related technology. No attempt is made to show structural details of technology in more detail than may be necessary for a fundamental understanding of the invention and various ways in which it may be practiced. In the drawings.

DETAILED DESCRIPTION OF THE INVENTION

Figure 1:
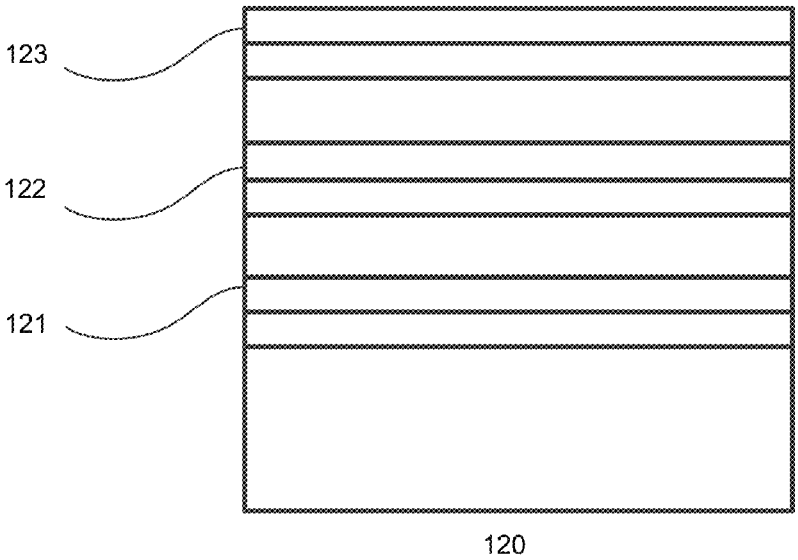
FIG. 1 depicts an exemplary countermeasure rack according to aspects of the invention.

It is understood that the invention is not limited to the particular methodology, protocols, etc., described herein, as these may vary as the skilled artisan will recognize It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a sensor" is a reference to one or more sensors and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

FIG. 1 shows an exemplary countermeasure rack 120. The countermeasure rack 120 includes a plurality, in this case three, rows of countermeasures 121-123. Other numbers of rows are also possible, e.g. two, four, or more, rows. In some examples, the rows of countermeasures 121-123 may be at least partially contained in a panel, frame or housing, as discussed further below.

In some examples, each row of countermeasures 121-123 may be configured to be initiated substantially simultaneously along the length of the row. For example, a strip of primer cord or other explosive initiator may be included along the length of the row such that initiating the primer cord fires an explosive or propellant along the entire row. Unless otherwise specified, "substantially simultaneously" may be understood to include the time it takes an explosive wave to travel the length of primer cord, or other initiator, included in the row, the time it takes for an explosive wave to travel through a high or low explosive, or other propellant, along the row, as well as the time it takes to fire separate initiators that are intended to be fired together.

In some examples, each row of countermeasures 121-123 may include segmented explosive charges that may be configured to be initiated separately from one another and/or to be initiated simultaneously with one or more other explosive charges in the row. For example, a plurality of explosive charges aligned along row 123 may include individual explosive initiators that can be separately active by a control system, such as those discussed further herein.

In some examples, rows 121-123 may be configured initiate separately from one another, initiate sequentially with one another, and/or initiate together, as well as selective combinations thereof. For example, under the control of a processor, such as discussed further below, certain firing events may involve firing a single row (or part of a row) of the countermeasure(s) (e.g. to defend against an incoming projectile), whereas other firing events may involve firing all of the rows simultaneously or sequentially (e.g. to counteract an IED explosion). Such flexibility can provide numerous advantages such as allowing rows to be fired depending on a specifically identified threat, allowing for multiple defensive fires in a given area of the vehicle, allowing a scalable IED response, reducing a peak force, etc.

Countermeasure rack 120 may be configured with multiple countermeasures/launchers, e.g. for IED defeat, using counter impulse. As discussed further below, such a system may also be configured to assist with projectile neutralization, such as incoming rockets, missiles or threats of various sorts.

In the embodiment shown in FIG. 1, each of rows 121-123 may include one or more countermeasures. For example, any number of individual countermeasure devices may be arranged side by side in a row. In a preferred embodiment, the rows of rack 120 includes small extruded, or individual, charges pointed upward, which fire upon command. For example, rack 120 may include a substantially unitary plate formed to hold rows of charges pointed upward, e.g. 45-135 degrees. Accordingly, when an underbelly explosion/event is detected, the charges in one or more rows 121-123 fire, providing an impulse downward. In some examples, such systems can also be set up for incoming threat defeat by firing off a single or multiple charges to counter an incoming projectile, disrupt a gas jet, etc.

Figure 2:
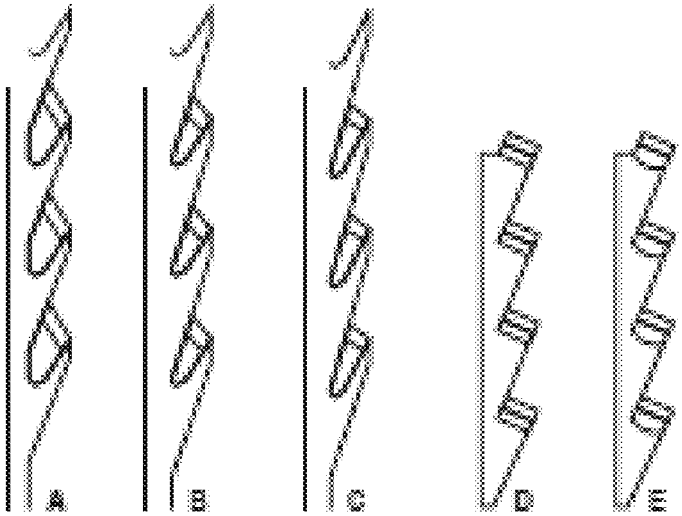
FIG. 2 depicts partial side views of exemplary countermeasure racks according to aspects of the invention.

Several exemplary panel cross sections that may be implemented in rack 120 are shown in FIG. 2, as examples A through E. As shown in FIG. 2, the rows of countermeasures may include upward facing cavities or troughs holding a propellant/explosive and an ejectable mass (examples A-C). In these examples, the troughs are angled slightly off vertical (e.g. 5-30 degrees) in the firing direction. In some examples, the trough angle/firing angle for two or more of the rows may be substantially parallel. The shape of the cavity and countermass may be significant in helping assure a good launch, as well as contributing to the downward impulse generated. It may also be important to design the shapes of the cavities, explosives and/or countermasses to provide minimal interference with upper and/or lower countermeasure rows.

As also shown in FIG. 2, the propellant/explosive in the rows may be disposed on a surface of the row (called a firing surface), without forming a substantial cavity/trough, such as shown in example D. In some examples, the row may include a cavity that is shaped to help focus the blast from the explosive or jet of propellant, such as shown in example E. In some examples, the row firing surface angle and/or firing angle for two or more of the rows may be substantially parallel.

In some examples, rows 121-123 may be detonated by an initiation from either or both ends of the rack 120. In addition to being end detonated, primer cord (also known as detonation cord), a faster explosive, or a series of other initiating devices, may be placed, for example, at the bottom of each trough in examples A-C of FIG. 2, or along the firing surfaces of example D, to obtain a bottom initiation. Systems fired by primer cord imbedded underneath the explosive or propellant (also referred to as the "energetic") in a channel or trough have advantageously been found to achieve a more uniform ignition/detonation compared to other methods, providing a better countermass launch. In some examples, two or more of the rows of a rack or panel, such as shown in FIGS. 1 and 2, may be initiated sequentially by a common initiator, e.g. by running a contiguous primer cord path from one row to another, etc.

It is noted that the various racks and panels mentioned above and described further below, may be integral to a supplemental armor plate that provides both active and passive protection.

In some examples, rows 121-123 may include segmented charges (i.e. charges that are capable of being detonated without detonating an adjacent explosive charge). Such charges may be detonated by various means known in the art, including, for example, electrical impulse, etc.

Figure 3:
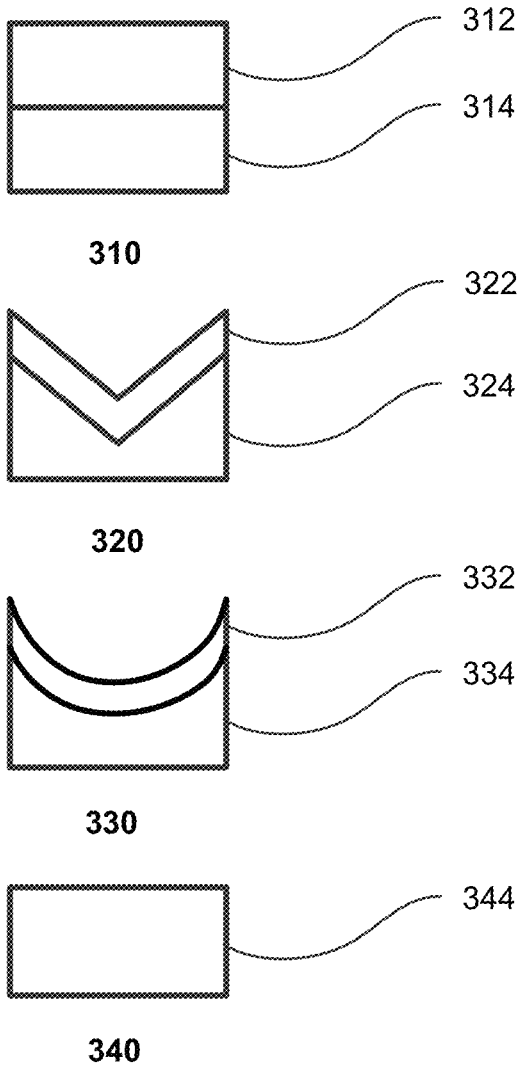
FIG. 3 depicts cut-away views of exemplary countermeasure shapes according to aspects of the invention.

FIG. 3 shows various cross sections of how an extruded, elongated, or segmented explosive component may be configured (with or without an ejectable/counter mass). For example, countermeasure 310 includes an energetic layer 314 capped by a mass layer 312. In some examples, such a countermeasure (as well as others shown in FIG. 3) may be disposed along all, most or some of the length of rows 121-123 shown in FIG. 1. Countermeasure 320 includes a shaped energetic layer 324 capped by a chevron shaped countermass layer 322, and countermeasure 330 includes a shaped energetic layer 334 capped by a dome-shaped countermass layer 332. Such shapes may be effective, for example, in forming a more collimated/focused explosive jet, wall or blade and/or mass expulsion, thereby limiting the potential damage around the countermeasure and/or improving the formation of a projectile-defeating explosive wall. Finally, countermeasure 340 includes a propellant 344 that may be used without a countermass layer. In the example show by countermeasure 340, just the impulse from the explosive itself may be used.

The material for the countermass may be solid or granular/powder and comprised of various materials. This may include, for example, steel, copper, tungsten or aluminum, as well as other metallic and non-metallic materials and compounds thereof.

The energetics may include high or low explosives (like LF-2), as well as propellants, electromagnetism or other force producer capable of ejecting countermasses and/or forming protective jets, blades, waves and the like. In some example, a wave shaper may be added to improve performance. In some examples, a buffer layer may be placed under the energetic, e.g. to reduce shock loading on the panel.

Figure 4:
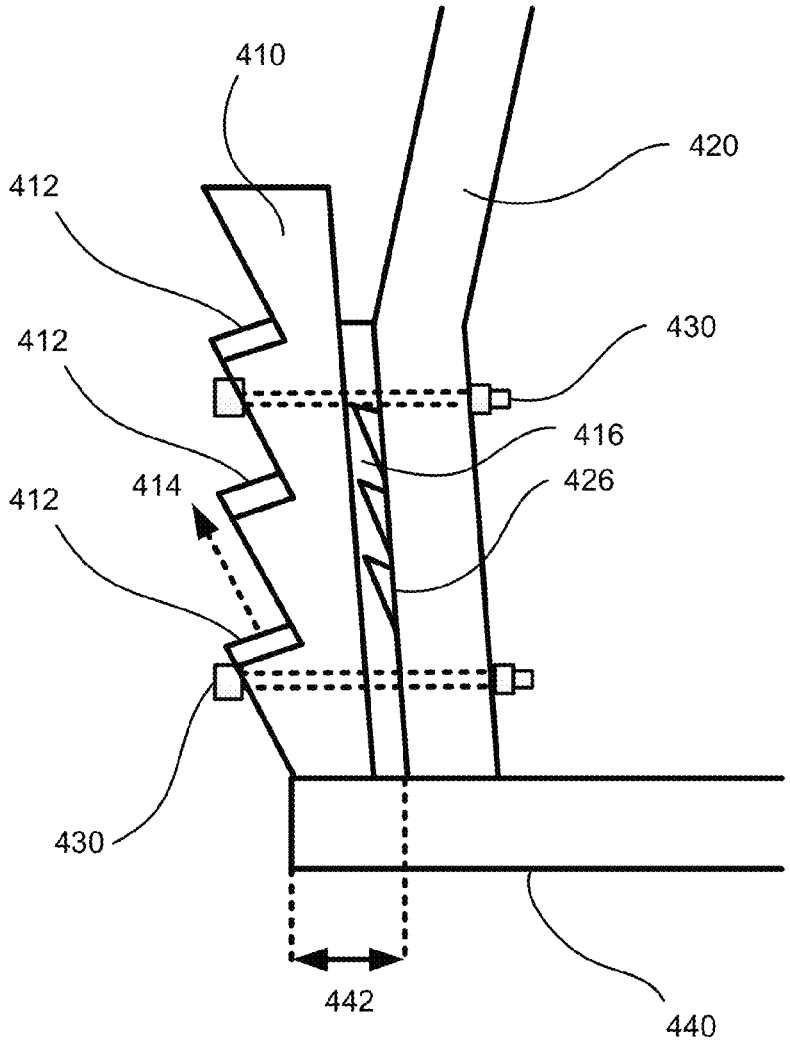
FIG. 4 is a simplified schematic view of an exemplary countermeasure rack system mounted to a vehicle according to aspects of the invention.

Additional details regarding mounting a countermeasure panel to a vehicle are shown in FIG. 4. As shown in FIG. 4, a countermeasure panel 410 may include a plurality of countermeasure rows 412, stacked vertically over one another. Each of rows 412 may be configured to fire in a direction substantially parallel to 414.

Panel 410 may be attached via bolts 430 to an armor plate 420 which may include, for example, a vehicle cab or other base structure, or a supplemental armor plate such as an A-kit armor plate, a B-kit armor plate, a C-kit armor plate, etc. The panel 410 may further include engagement means such as teeth 416 that are configured to engage with corresponding teeth 426 of the armor plate 420. As discussed further herein, use of engagement means such as teeth 416 and 426 has been found by the inventors to provide significant increases in the load bearing/transfer characteristics of countermeasure devices such as panel 410 and others. For example, for countermeasures that are bolted to the vehicle or armor plates, the number of bolts can be reduced from fifteen or more to four. This can make attachment and removal of countermeasures much faster, which is significant since many military vehicles are not equipped with such countermeasures until they arrive in theater, and may have to have the countermeasures removed when being shipped back from active combat areas.

The panel 410 is optionally supported by a portion 442 of underplate 440 that extends beyond the armor plate 420. Use of such support means, alone or in combination with other engagement means, has also been found by the inventors to provide increases in the load bearing/transfer characteristics of countermeasure devices such as panel 410 and others, e.g. by transferring substantial amounts of the blast forces generated by the countermeasure(s) directly to the underplate of the vehicle.

As mentioned previously, individual rows of countermeasures, such as rows 412, can be fired sequentially, e.g. to reduce the peak forces and provide a more sustained downward force on the vehicle. In some examples, the delay between initiating one row and another may be based on the amount of time it takes for a row to fully detonate, e.g. in embodiments that initiate multiple rows with a serpentine length of primer cord. For a 1.0 meter long row with a high explosive, the time may be approximately 150 microseconds, or in a range of 100-200 microseconds. The preferred or actual times may vary, depending on, for example, row length and detonation velocity.

In some examples, individual rows of countermeasures, such as rows 412, can be selectively fired, e.g. as part of a projectile defense system that forms one or more explosive jets, walls or blades, of energy and/or countermass material that can be used to divert, diminish or destroy an incoming projectile, explosive jet, targeting energy, or other threat.

Figure 5:
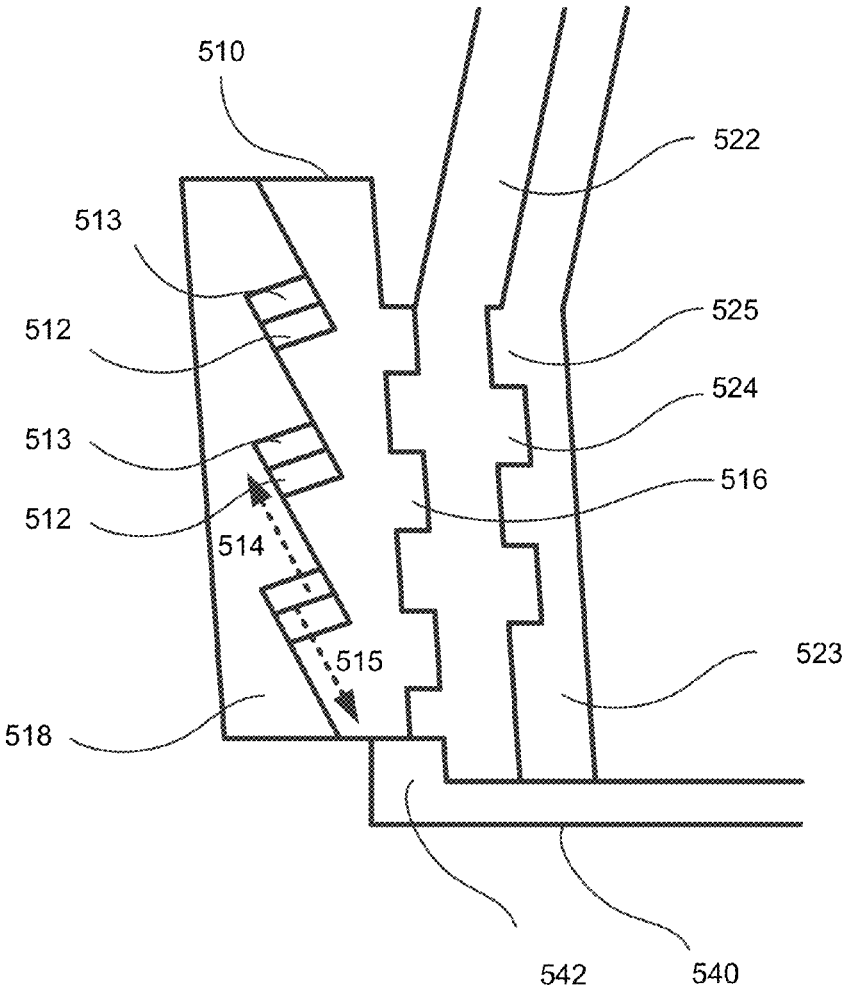
FIG. 5 is a simplified schematic view of another exemplary countermeasure rack system mounted to a vehicle according to aspects of the invention.

FIG. 5 provides details of an alternative mounting configuration according to further aspects of the invention. As shown in FIG. 5, a countermeasure panel 510 may include a plurality of countermeasure rows 512, stacked vertically over one another, similar to the configuration shown in FIG. 4. Each of rows 512 may be configured to fire in a direction substantially parallel to 514.

Another countermeasure panel 518 may include a plurality of countermeasure rows 513, also stacked vertically over one another, and with one or more of the rows 513 opposite a corresponding row 512 of the panel 510. Each of rows 513 may be configured to fire in a direction substantially parallel to 515, which may be opposite or nearly opposite to direction 514.

When fired simultaneously, or nearly simultaneously, the opposing countermeasures 512 and 513 can produce an even greater downward force on the vehicle than that produced by a single countermeasure panel such as 510. However, other configurations and firing schemes are also possible. Various charge geometries may be stacked on each other to increase performance, and may be initiated at separate times. The arrangement and timing of various energetics in such panels may be beneficial, for example, in increasing pressure between plates without leaking (e.g. using a substantially simultaneous detonation scheme), or to induce tilt in a panel to enhance projectile defeat (e.g. using a top-to-bottom sequential initiation).

Panels 510 and/or 518 may be attached to an armor plate 522 and/or through armor plate 522 to armor plate 523. Armor plate 522 may include, for example, a B-kit armor plate and/or a C-kit armor plate. Armor plate 523 may include, for example, a vehicle cab, an A-kit armor plate and/or a B-kit armor plate. The panel 510 may further include engagement means such as rails 516 that are configured to engage with corresponding channels of the armor plate 522. The armor plate 522 may further include engagement means such as rails 524 that are configured to engage with corresponding channels and/or rails 525 of the armor plate 523. The various rails and channels may be formed using various means such as welding, machining, etc.

Use of engagement means such as rails 516, 524 and corresponding channels may also provide significant increases in the load bearing/transfer characteristics of countermeasure devices such as panels 510, 518, and others, and improve the ability of additional armor plates such as armor plate 522 to distribute countermeasure forces.

The panel 510 is optionally supported by a portion 542 of underplate 540 that extends beyond the armor plate 523 and wraps at least partially around a portion of armor plate 522. Use of such support means, alone or in combination with other engagement means, has also been found by the inventors to provide increases in the load bearing/transfer characteristics of countermeasure devices such as panel 510 and others, e.g. by transferring substantial amounts of the blast forces generated by the countermeasure(s) to the underplate of the vehicle via the panel 510 and the armor plates 522 and 523.

In some examples, a panel such as those described above could be integrated directly on the vehicle, or attached as part of an additional armor kit. Additionally, a dampener material may be placed behind the panel or between the panel and vehicle armor to help reduce internal shock and also spread the load into the vehicle.

Although the embodiment shown in FIG. 5 includes opposing countermeasures 512, 513, some examples may only include one such countermeasure, e.g. 512. In some examples, additional energetic material may also be disposed on various areas of the surfaces between panel 510 and panel 518. Energetics on one or more surfaces between panel 510 and panel 518 may be used, for example, to improve the active armor capabilities of the panels, to open a gap between the panels (reducing obstruction of the jet from countermeasures 512), etc.

Figure 6:
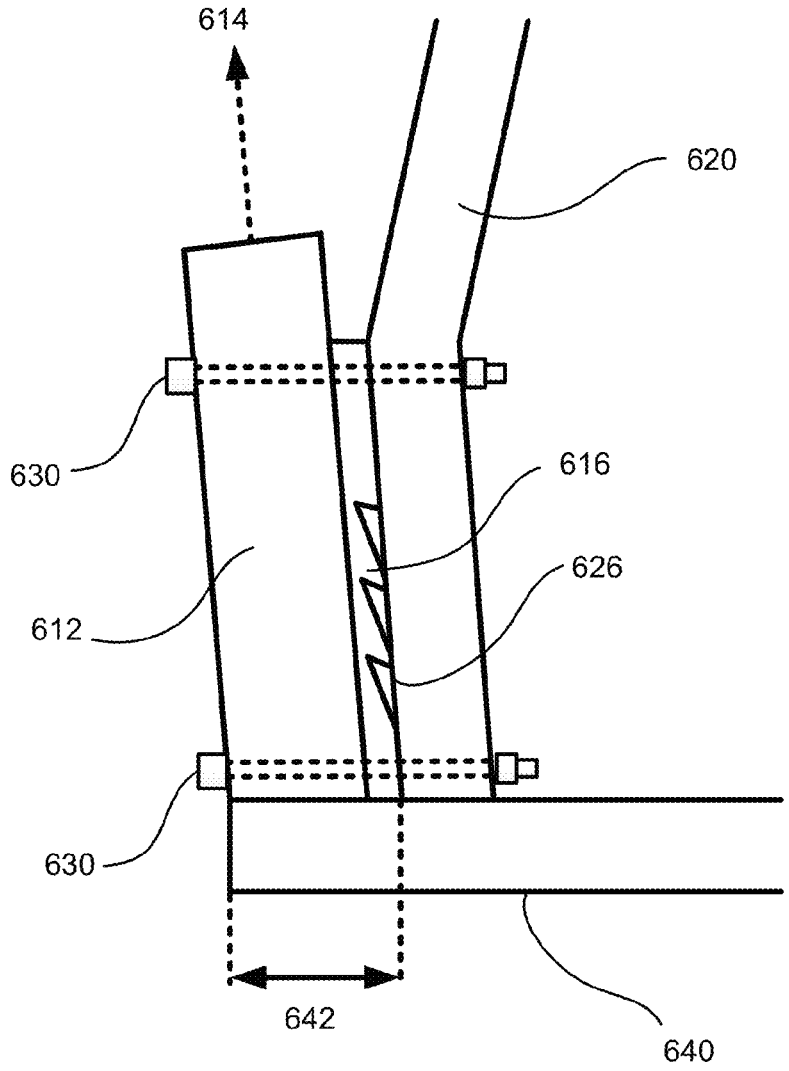
FIG. 6 is a simplified schematic view of an exemplary countermeasure system mounted to a vehicle according to aspects of the invention.

Various of the systems shown in FIGS. 4-6 may be covered by a "nuisance shield," which can be best fragmented between rows of countermeasures. In some examples, explosives on one or more countermeasure rows may be used to help fracture such shields as part of the techniques described herein.

As mentioned previously, mounting techniques including features described herein may find applicability in other countermeasure systems such as canisters, canister racks and other countermeasures known in the art.

For example, FIG. 6 provides details of an alternative mounting configuration for a tube launcher, or bank of such tubes, according to further aspects of the invention. As shown in FIG. 6, a countermeasure 612 may include a tube housing, for example, an explosive, a thruster, and/or a countermass. Countermeasure 612 may be configured to fire substantially in direction 614.

Countermeasure 612 may be attached via bolts 630 to an armor plate 620 which may include, for example, part of a vehicle cab, an A-kit armor plate, a B-kit armor plate and/or a C-kit armor plate. The countermeasure 612 may further include engagement means such as teeth 616 that are configured to engage with corresponding teeth 626 of the armor plate 620. Thus, engagement means such as teeth 616 and 626 can be used improve the load bearing/transfer characteristics of countermeasure devices such as tube launchers and others.

Countermeasure 612 may optionally be supported by a portion 642 of underplate 640 that extends beyond the armor plate 620.

It has been found that, in some configurations such as those discussed above, it is unnecessary to bolt the countermeasure panels through a B-armor kit, e.g. if attachment points and/or engagement means of the B-kit are adequate to take the load. This can allow greater flexibility in, and adjustment of, the location of attachment points between the B-kit armor plate and the vehicle, e.g. since thru-bolting the countermeasure often requires a footprint that is difficult to accommodate on various parts of the vehicle.

Figure 7:
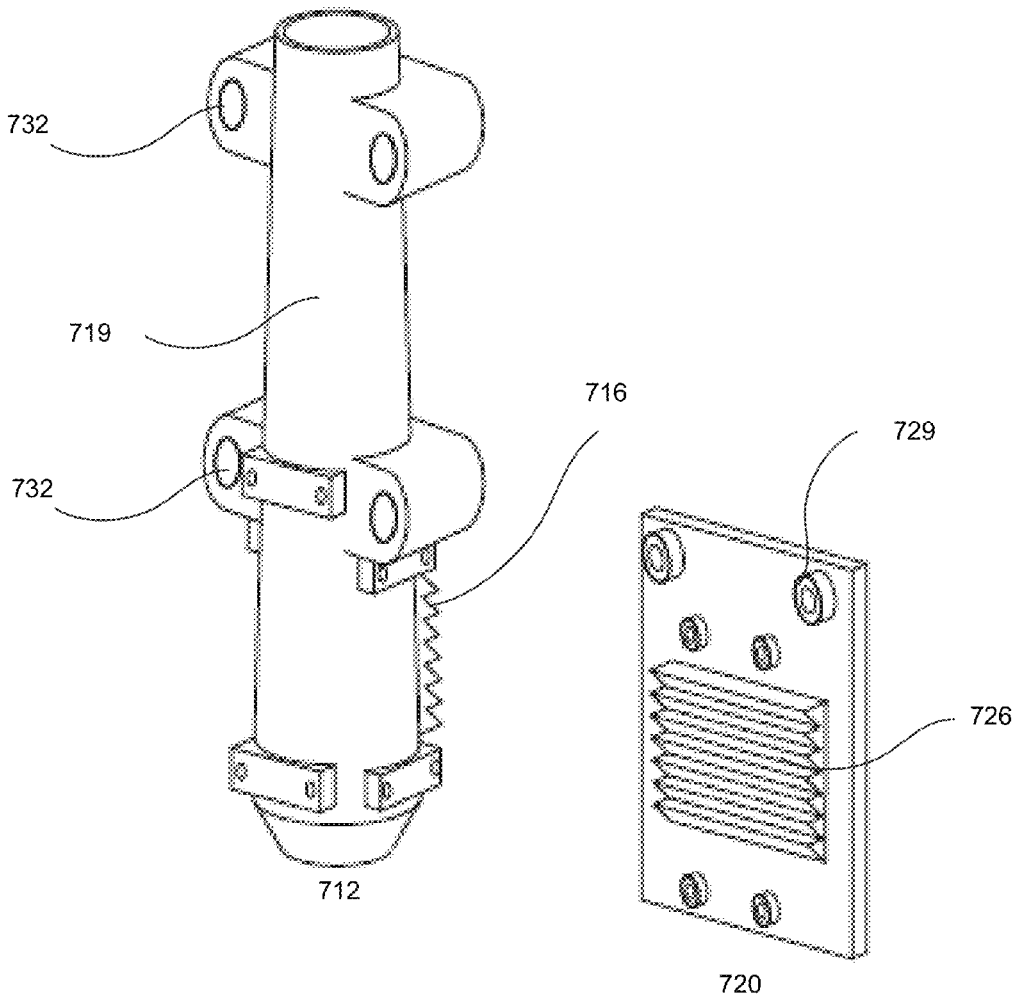
FIG. 7 is a simplified schematic view of an exemplary countermeasure and armor plate according to aspects of the invention.

FIG. 7 shows an alternative mounting configuration for a countermeasure 712, and armor plate 720, according to further aspects of the invention. As shown in FIG. 7, countermeasure 712 includes a tube/housing 719, and various attachment mechanisms 732, in this case though-holes that can be used, for example, to bolt the countermeasure 712 to an armor plate, vehicle frame, etc. Armor plate 720 includes attachment mechanisms 729, which may be configured in a similar arrangement as one or more of engagement mechanisms 732. In some examples, attachment mechanisms 729 may include threaded wells, threaded or smooth bores, etc.

As discussed previously, countermeasures, such as countermeasure 712, may include an explosive initiator, high and/or low explosives, propellants, countermasses, etc.

Countermeasure 712 also includes an engagement mechanism 716, in this case including a plurality of horizontal teeth configured to engage with corresponding teeth of engagement mechanism 726 of armor plate 720.

Armor plate 720 may be, for example, part of an A-kit armor plate, a B-kit armor plate and/or a C-kit armor plate.

Figure 8:
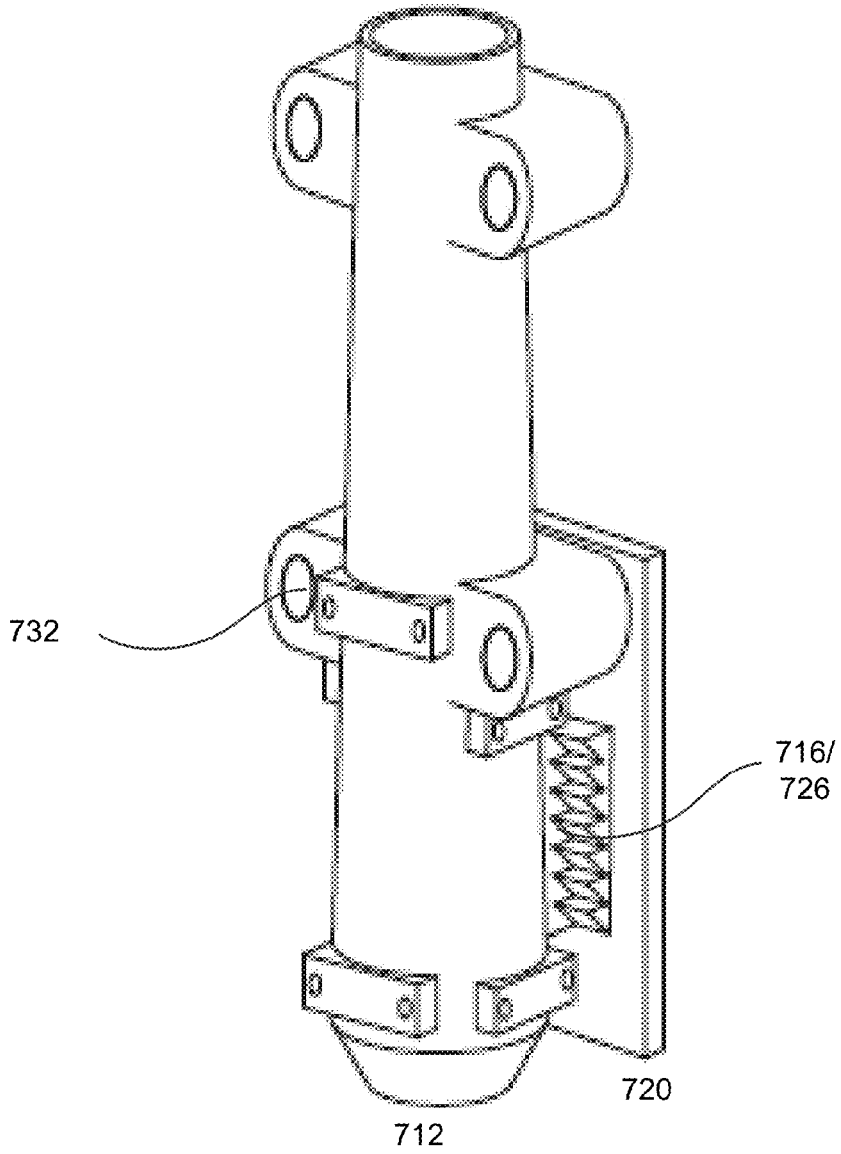
FIG. 8 shows the countermeasure from FIG. 7 mounted to the armor plate according to aspects of the invention.

FIG. 8 shows an example of how the countermeasure 712 may be mounted to the armor plate 720 with corresponding teeth 716/726 engaged with one another and supporting the countermeasure 712. It should also be noted that, in some examples, angled teeth such as shown in FIGS. 8 and 9 can advantageously be used to translate forces in toward the armor plate of the vehicle, rather than merely supporting the countermeasure forces by friction and shearing of mounting bolts.

Figure 9:
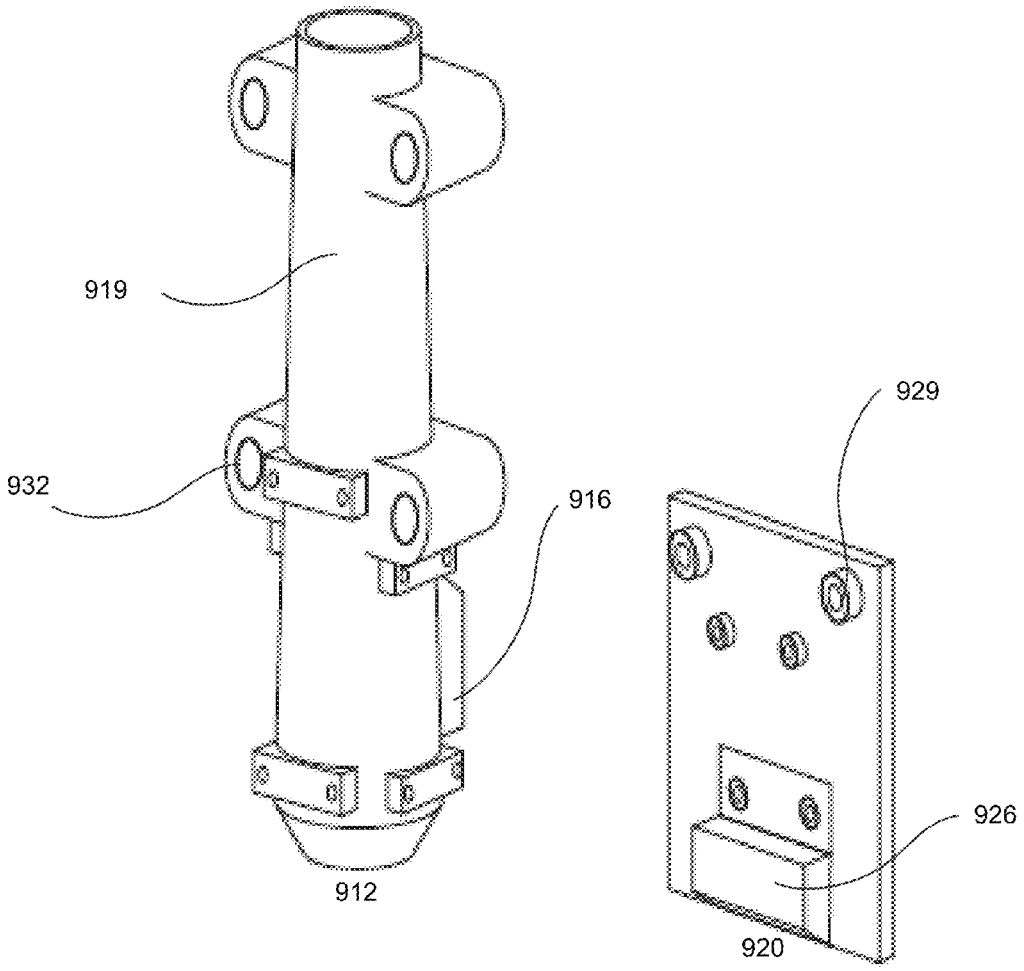
FIG. 9 is a simplified schematic view of another exemplary countermeasure and armor plate according to aspects of the invention.

FIG. 9 shows an alternative mounting configuration for a countermeasure 912, and armor plate 920, according to further aspects of the invention. As shown in FIG. 9, countermeasure 912 includes a tube/housing 919, and various attachment mechanisms 932, in this case though-holes that can be used, for example, to bolt the countermeasure 912 to an armor plate, vehicle frame, etc. Armor plate 920 includes attachment mechanisms 929, which may be configured in a similar arrangement as one or more of engagement mechanisms 932. In some examples, attachment mechanisms 929 may include threaded wells, threaded or smooth bores, etc.

Countermeasure 912 may also include an engagement mechanism 916, in this case including a horizontal shelf configured to engage with a corresponding engagement mechanism 926 of armor plate 920. An engagement mechanism such as shelf 916 may also advantageously be used to rest on a lip, or other exposed or extending portion, of a vehicle underplate such as shown in FIGS. 4-6.

Armor plate 920 may be, for example, part of a vehicle cab, part of an A-kit armor plate, a B-kit armor plate and/or a C-kit armor plate.

Figure 10:
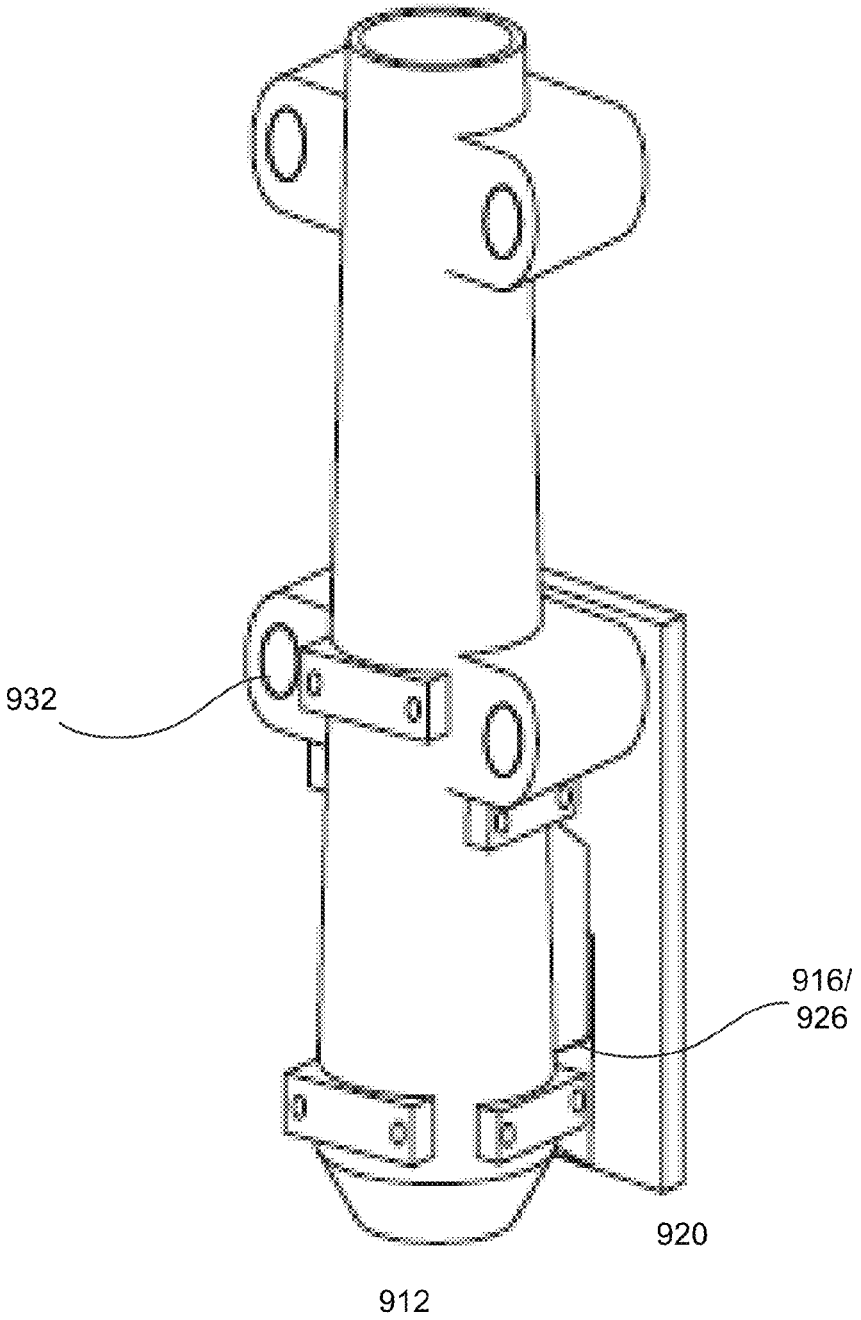
FIG. 10 shows the countermeasure from FIG. 9 mounted to the armor plate according to aspects of the invention.

FIG. 10 shows an example of how the countermeasure 912 may be mounted to the armor plate 920 with corresponding shelves 916/926 engaged with one another and supporting the countermeasure 912.

In some examples a countermeasure ledge or underside can be supported by, for example, an extension of the underbody plate, an existing vehicle ledge, or a ledge that is welded to the vehicle cab or B-Kit armor.

According to aspects of the invention, the systems and processes described herein may be advantageously employed to mount, control and/or activate various types of explosive blast, propellant thruster and/or mass ejector-type countermeasures, some examples of which are described below.

Broadly speaking, countermeasures themselves may be of varying types yet remain consistent with the present invention. Advantageously, however, countermeasures may include channels (such as discussed above), and/or cartridges, into which ejectable masses and charges are loaded. Currently preferred ejectable masses are predominantly solids (as opposed to liquids or gases), with some solids either being disintegrable or comprising multiplicities of disintegrating particles. If so, the likelihood of serious injury to a bystander impacted by a portion of the ejected mass may be reduced.

Some examples may include cartridge countermeasures that may be placed in barrels mounted to or otherwise connected or attached to vehicles. The barrels may be constructed in sets or individually as desired and configured to receive cartridges in any manner allowing initiation of the explosive/propellant.

In some versions of the invention, countermeasure panels, banks of barrels, etc. may be mounted at various locations around a vehicle, e.g. vehicle corners, sides, front, or rear.

Countermeasures may include, for example, a housing containing a mass and/or propellant, and a charge. Countermeasure may be connect to an ESAD and initiator using conventional detonation cord, or other explosive initiation means known in the art.

A countermeasure (CM) bank assembly may include a plurality of countermeasures such as shown in FIGS. 7-10. The CM banks may be assembled to a vehicle domestically, or at a field depot in theater. CM cartridges, FCDC connectors and ESADs may be shipped separately, with the CM cartridges installed in theater. The CM cartridges may be removable from the vehicle for shipping, and may come with, for example, flexible confined detonating cord connector to aid in installation and removal.

Presently preferred is that barrels of countermeasures such as countermeasure 712 in FIG. 8, be vertical (or substantially so) with their openings positioned upward when mounted to a vehicle. In this manner, a countermeasure 712 will be fired upward from the vehicle upon deployment, producing a downward force vector upon ejection. Such downward force vector is intended to counteract (in whole or in part) an upward force impacting a vehicle because of, e.g., explosion of a mine or IED, collision of the vehicle with an object, or departure of the vehicle from a roadway or other normal travel surface.

Alternatively, one or more countermeasures 712 could be tilted or otherwise repositionable relative to a (nominal) vertical orientation. If so, deployment of materials loaded therein could be used to establish different force vectors acting on a vehicle, or the tube 719 (regardless of orientation) could be used to deploy flares, missiles, projectiles, or other objects for various purposes.

Reactive armor plates or tiles may also be deployed, as may any mass associated with a vehicle (e.g. engine, engine cover, battery, water supply, passive armor, etc.).

Figure 11:
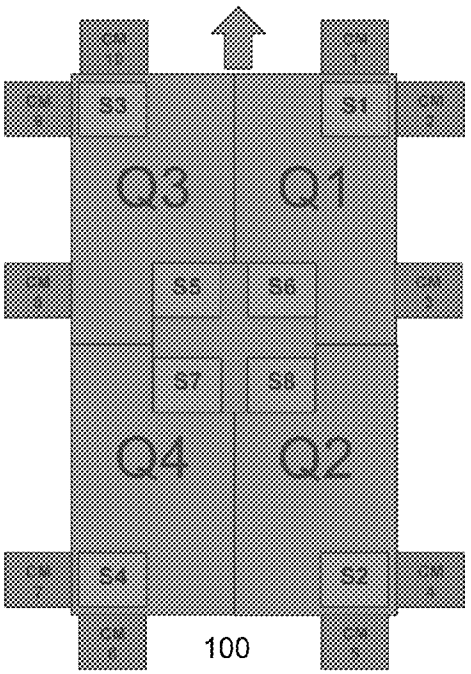
FIG. 11 is a simplified schematic diagram showing a plurality of sensor packages and countermeasures disposed in a vehicle, and a chart showing correspondence between the sensor packages and countermeasures, according to aspects of the invention.

FIG. 11 shows an exemplary arrangement of sensor packages (S1-S8) disposed in different parts of a vehicle 100. In the embodiment shown in FIG. 11, each "quadrant" (Q1-Q4) includes at least one sensor package (e.g. S1-S4, respectively) and may include one or more sensor packages (e.g. S5-S8). In some embodiments, sensor packages S5-S8 may be replaced by a single sensor package, which may be placed, for example, in an approximate center of the vehicle, or other location. The placement of sensor package S1-S8 may vary, for example, based on specific weight distributions of the vehicle, rigidity distributions, wheelbase dimensions, and other factors that may affect the responsiveness of the vehicle to an explosion, collision and/or dynamic driving incident.

As also shown in FIG. 11, each vehicle quadrant may include one or more explosion countermeasures (CM1-CM10). As described further herein, one or more of the countermeasures may be associated with a quadrant and/or sensor package(s) such that selective activation of appropriate countermeasures may be made based on the acceleration or threat data from specific sensor packages. In the embodiment shown in FIG. 11, countermeasures CM1 and CM10 are disposed in proximity to the front corners of the vehicle 100, countermeasures CM5 and CM6 are disposed in proximity to the rear corners of the vehicle 100, countermeasures CM2 and CM4 are disposed in proximity to the right side corners of the vehicle 100, countermeasures CM7 and CM9 are disposed in proximity to the left side corners of the vehicle 100, and countermeasures CM3 and CM8 are disposed in a mid-portion on either side of the vehicle 100 (in this case forward of center). In embodiments, exemplary systems may include various numbers of sensor packages, e.g. five or more sensor packages, six sensor packages, seven sensor packages, eight sensor packages, etc. In embodiments, exemplary systems may include various numbers of countermeasures, e.g. four or more countermeasures, eight or more countermeasures, twelve or more countermeasures, sixteen or more countermeasures, etc.

The table included in FIG. 11 shows an exemplary firing correspondence between the sensor packages S1-S8, the quadrants Q1-Q4 and the countermeasures CM1-CM10. As can be seen in FIG. 11, the front quadrants Q1 & Q3, include three countermeasures each (i.e. CM1-CM3 and CM8-CM10, respectively). Therefore, confirmation of a firing event for sensor package S1 (along with any necessary confirmation from other sensor packages), may result in CM1-CM3 activating, without activating CM4-CM10. Sensor packages S5-S8 may not be specifically associated with individual countermeasures and may be used, for example, to confirm firing events detected by other sensor packages, activate additional arm locations, and/or other data collection. It should be understood that the exemplary arrangements shown in FIG. 11, and related correspondences shown in FIG. 11, may be altered, e.g. by including different numbers of sensor packages, different numbers of countermeasures, different locations, and/or different relationships, without departing form the overall concepts of the invention.

In some embodiments, the multiple sensor packages used to confirm a firing or other event may be differentiated such that specific sensor packages require confirmation from other pre-designated sensor packages. This may be advantageous for a number of reasons. For example, certain sensor packages may be attached to parts of the vehicle that might be blown off in an explosion (e.g. sensor packages mounted to the periphery of the vehicle). Therefore, sensor packages disposed on the periphery of the vehicle (e.g. S1-S4 shown in FIG. 11), may be associated with one or more sensor packages disposed toward the middle of the vehicle (e.g. S5-S8 shown in FIG. 11) for firing event confirmation. In the embodiment shown in FIG. 11, S1 may be associated with S6, S2 may be associate with S8, S3 may be associate with S5, and S4 may be associate with S7. However, other configurations are also possible, such as associating all of the peripheral sensor packages with one centrally mounted sensor package, and/or creating dynamic associations in order to tailor the necessary countermeasure response.

As described above, exemplary systems and methods may use multiple sensor packages, each containing multiple accelerometers, proximity detectors or other sensors. It should be further understood that sensing systems and algorithm described herein can be configured to function through individual sensor data drop-outs. For example, exemplary systems may be configured such that data interruption from any one of the available sensor packages (e.g. S1-S4 and/or S5-S8) will not preclude determining that an explosion has occurred, or that a projectile is inbound, based on data received from the remaining sensors. Additionally, exemplary systems may be configured such that data interruption from any one of the sensors within a sensor will not preclude determining that a firing event has occurred based on data received from the remaining sensors.

It is noted that incoming side threats, such as projectiles, could be detected with various methods including, for example, radar or simple "make screens" (optical or on nuisance shield).

Figure 12:
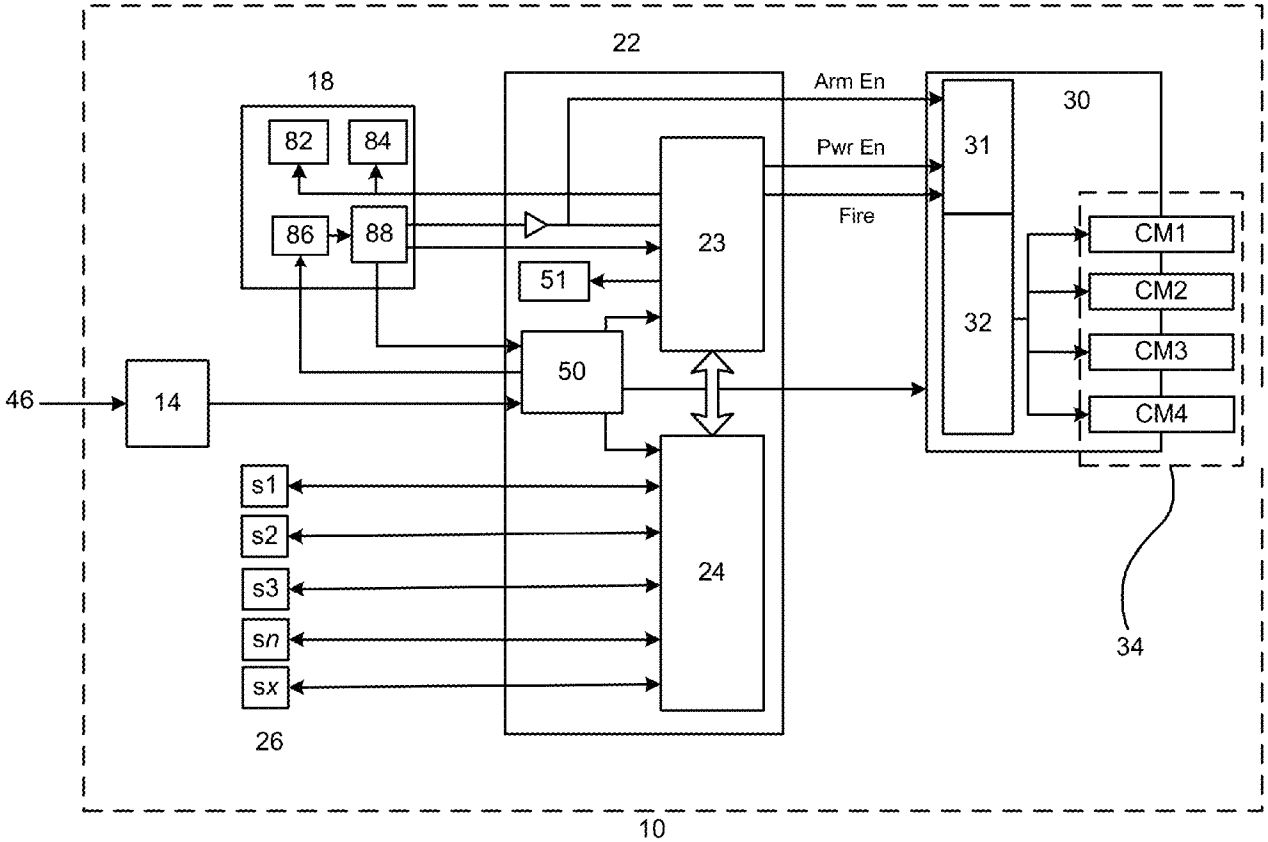
FIG. 12 is a schematic block diagram of aspects of an exemplary TAS consistent with the present invention.

Depicted in FIG. 12 is a simplified schematic of an exemplary trigger and activation system (TAS) 10 of the present invention. TAS 10 may include first responder unit (FRU) 14, control display assembly (CDA) 18, processor 22, one or more sensors 26, electronic safe and arm device (ESAD) 30, and one or more countermeasures 34. Although conceivably useful wherever force-related countermeasures are desirably deployed, as to prevent vehicle rollover, for example, TAS 10 is especially designed for use in connection with a vehicle operating in a theatre in which IEDs, mines, or other explosive devices may be present, along with other anti-vehicle weapons, such as rocket propelled grenades, guided missiles, etc.

A processor 22 (which may be configured in various ways described herein), may include, for example, a microcontroller 23 connected via a bus to interface system (IC) 24, power conditioner 50, data recorder 51, and various other electronic storage, and/or communication means known by those of skill in the art. IC 24 may be connected to a plurality of sensors 26, including acceleration sensor packages, projectile detectors, as well as various other sensor types (sx), which may include, for example, cameras, light sensors, radiation sensors, deformation sensors, heat sensors, pressure sensors, contact sensors, proximity sensors, strain sensors, and force sensors.

In embodiments, the processor 22 may be in communication with other sensor types (sx) that sense a different type of condition than the acceleration sensors, and the processor 22 may be configured to process signals received from the other sensor devices in determining whether to initiate the countermeasure. For example, when the other sensor types (sx), include cameras, light sensors, radiation sensors, deformation sensors, heat sensors, pressure sensors, contact sensors, proximity sensors, strain sensors, and/or force sensors, one or more of a change in light patterns, detected light, radiation, pressure, temperature, contact, proximity, strain and/or force may be used as an independent indicator and/or an additional confirmation threshold that further informs the decision making process on whether an explosion has occurred, and/or whether to activate a countermeasure to counter an incoming projectile or other threat.

In some examples, multiple sensor types may be used to more precisely select and time the firing of a particular countermeasure, countermeasure row and/or countermeasure panel to defeat or degrade an incoming projectile such as a rocket or missile. In some examples, the ESAD 30 may be configured to send a firing instruction to the same countermeasure to counter an explosion, such as an IED, based on analysis of first sensor data (e.g. accelerometer data), and to counter a projectile, or other threat, based on analysis of second sensor data that includes at least some different sensor types than the first sensor data (e.g. active RF sensor data).

ESAD 30 may include various components including, for example, controller 31 including hardware and/or software for processing signals including Arm, Power and Fire instructions received from the processor 22. ESAD 30 may further include a safety 32 through which firing signals to any of countermeasures 34 must pass. Controller 31 may be configured to power on, or otherwise make ready, safety 32 such that Fire instructions received from the processor 22 are communicated, e.g. by electrical current sufficient to activate an initiator, to appropriate countermeasures 34.

The ESAD 30 may function to arm and initiate countermeasures 34 upon command of processor 22. Like various other aspects of the inventive systems, the ESAD 30 preferably "fails safe"—i.e. if it is non-functional, it enters or reverts to a mode in which countermeasures 34 cannot activate. Primer cord or any other suitable material may connect the ESAD 30 to the countermeasures 34. In embodiments, the ESAD 30, or other safe and arming device, may be collocated with the countermeasure, e.g. in a countermeasure cartridge.

With TAS 10 in the "arm enable" mode, processor 22 controls deployment of countermeasures 34. Processor 22 directly or indirectly receives signals from sensors 26 (e.g. via IC 24 and any busses) and determines (1) if making ready ESAD 30 is appropriate, and (2) if deployment of any countermeasure 34 is appropriate. If making ready and/or deployment is appropriate, as described further herein, processor 22 signals ESAD 30 accordingly. In some versions of the invention, processor 22 may be housed in an enclosure having deformable brackets so as to allow dampening of shocks otherwise likely experienced by the processor 22.

FRU 14 may include, for example, a switch interposed in the main power supply line 46 of the vehicle between a vehicle power supply (e.g. a battery or electrical generator) and ESAD 30 to which countermeasures 34 are connected. If the switch in FRU 14 is open, electricity is not available for ESAD 30 to arm the countermeasures 34 for deployment.

In embodiments, various parts of the TAS may be connected to and/or include an auxiliary power source, in addition to the main power supply line 46 of the vehicle. For example, power conditioner 50 may be connected to and/or include an auxiliary power source sufficient to power essential parts of the TAS 10 for a period of time sufficient to deploy countermeasures if the vehicle experiences an IED blast that disrupts power from main power supply line 46. The auxiliary power source may be, for example, a capacitor (e.g. a 27,000 uF super capacitor) that allows the system to function for at least 100 ms after battery power is lost. This can assure a functioning system even if the battery power is lost from the IED blast.

As noted in FIG. 12, CDA 18 beneficially may, but need not necessarily, include a system status indicator 82, a safety status indicator 84, a power indicator 86, and an armed power control indicator 88. CDA 18 additionally advantageously may be powered by power supply 46 (albeit perhaps after the power undergoes conditioning by power conditioner 50), although other sources of electricity possibly may be used instead. Outputs of CDA 18 may be connected electrically to (at least) processor 22.

Once a decision to activate a countermeasure is made, a FIRE command signal may be sent to one or more countermeasures 34 depending on, for example, the sensor packages meeting the selected acceleration and/or projectile detection criteria, and quadrant correspondence of sensor packages and/or countermeasures.

Depending on the locations and types of forces or threat indicators encountered by sensors 26, any one or more countermeasure panels, rows of countermeasures, or individual countermeasures may be initiated. Moreover, if a panel includes more than one row of countermeasures, less than all countermeasures may be initiated at any particular time. Launching of countermeasure panels, rows of countermeasures, or individual countermeasures further may be staggered or sequenced in time.

In some example, a countermeasure may include a propellant or other substance capable of causing a countermeasure to eject from a vehicle. Upon receipt of a suitable signal from processor 22, ESAD 30 activates an initiator, which in turn ignites detonation cord connected to a countermeasure 34. Detonation of the cord can cause deflagration (if pyrotechnic) or other activation of charges and/or propellants so as to eject a mass from the countermeasure. A single initiator may be employed to launch any number of countermeasures 34; alternatively, each countermeasure 34 may be associated with a separate initiator. To expedite initiation, capacitors associated with one or more initiators may be pre-charged under certain conditions, such as when the ESAD is made ready.

In some embodiments, a computer-readable medium containing computer-readable instructions recorded thereon is provided. For example, one or more memory devices (included in, or in communication with, processor 22 shown in FIG. 12) may store an application or computer program product accessible from a computer-usable or computer-readable medium providing program code for use by or in connection with processor 22 or any instruction execution system. For the purposes of this description, a computer-usable or computer-readable medium may include any tangible medium or apparatus that can contain, store, communicate, propagate, or transport the program for use by or in connection with the instruction execution system, apparatus, or device.

The medium may be an electronic, magnetic, optical, electromagnetic, infrared, or semiconductor system (or apparatus or device), or a propagation medium. Examples of a computer-readable medium include a semiconductor or solid-state memory, magnetic tape, a removable computer diskette, a random access memory (RAM), a read-only memory (ROM), a rigid magnetic disk and an optical disk. Current examples of optical disks may include compact disc read-only memory (CD-ROM), a rewritable compact disc (CD-R/W), and digital video disc (DVD).

A data processing system (e.g., processor 22 shown in FIG. 12) is suitable for storing and/or executing program code will include at least one processor coupled directly or indirectly to memory elements through a system bus. The memory elements may include local memory employed during actual execution of the program code, bulk storage, and cache memories which provide temporary storage of at least some program code in order to reduce the number of times code must be retrieved from bulk storage during execution. Input/output or I/O devices (including but not limited to keyboards, displays, pointing devices, etc.) may be coupled to the system either directly or through intervening I/O controllers. Network adapters may also be coupled to the system to enable the data processing system to become coupled to other data processing systems or remote printers or storage devices through intervening private or public networks. Modems, cable modems, and Ethernet cards are just a few of the currently available types of network adapters.

Any wireless protocol using any wireless communication standard may be supported by the systems and methods described herein. In addition, any computing device may be adapted to support the techniques disclosed herein. Furthermore, it is to be understood that the various embodiments described above may be used and adapted for other countermeasure controls not specifically described herein. It is to be understood that the examples and embodiments described above are for illustrative purposes only and that various modifications or changes in light thereof will be suggested to persons skilled in the art, and are to be included within the spirit and purview of this application and scope of the appended claims. Therefore, the above description should not be understood as limiting the scope of the invention as defined by the claims.

What is claimed is:

1. A countermeasure system configured to be mounted to a vehicle, said system comprising:

a countermeasure configured to fire in an upward direction when mounted to the vehicle;

a first sensor device including a plurality of accelerometers configured to detect vertical acceleration of the vehicle;

a second sensor device configured to detect projectiles in proximity to the vehicle;

a processor in communication with said first sensor device and said second sensor device, said processor configured to initiate the countermeasure based on results of processing signals from said first sensor device, and based on results of processing signals from said second sensor device.

2. The system of claim 1, wherein said countermeasure includes a frame, and at least two rows of countermeasures disposed on the frame, wherein, each row of the countermeasures includes at least one of an elongated explosive charge disposed along the length of the row or a plurality of segmented explosive charges along the length of the row.

3. The system of claim 2, wherein each row of the countermeasures is configured to fire in a substantially parallel direction to at least one other row of the countermeasures.

4. The system of claim 2, wherein each row of the countermeasures comprises an elongated explosive charge disposed along the length of the row.

5. The system of claim 2, wherein the frame includes a plurality of ridges on a side opposite to the at least two rows of countermeasures, the plurality of ridges configured to engage with corresponding ridges on the vehicle.

6. The system of claim 1, wherein the processor is further configured to selectively initiate individual countermeasures in different areas of the vehicle based on at least one of the results of processing signals from said first sensor device and the results of processing signals from said second sensor device.

7. The system of claim 1, wherein the countermeasure includes one or more of a mass ejector and a thruster.

8. The countermeasure system of claim 1, wherein the countermeasure comprises:

a housing; and at least one of a mass ejector and a thruster held by the housing, wherein, the housing includes at least one attachment point for fixedly attaching the housing to a vehicle, and a plurality of ridges configured to engage with corresponding ridges on the vehicle when the countermeasure is mounted to the vehicle.

9. The system of claim 8, further comprising a supplemental armor panel including the corresponding ridges.

10. The system of claim 8, including at least two rows of countermeasures held by the housing, each of the at least two rows of countermeasures including an elongated explosive charge and an elongated mass configured to be ejected by the elongated explosive charge.

11. The system of claim 8, including:

a first countermeasure held by the housing and configured to fire in a first direction, and a second countermeasure mounted substantially opposite the first countermeasure and configured to fire in a substantially opposite direction to the first direction.

12. The system of claim 11, including a plurality of the first countermeasures held by the housing, and a plurality of the second countermeasures mounted substantially opposite the plurality of first countermeasures.

13. The countermeasure system of claim 1, wherein the countermeasure includes:

a frame; and at least two rows of countermeasures disposed on the frame, wherein, each row of the countermeasures includes at least one of an elongated explosive charge disposed along the length of the row or a plurality of segmented explosive charges along the length of the row.

14. The system of claim 1, wherein each row of the countermeasures is configured to be initiated substantially simultaneously along the length of the row.

15. The system of claim 1, wherein each row of the countermeasures is configured to be initiated separately from at least one other row of the countermeasures.

16. The system of claim 1, wherein each row of the countermeasures is configured to fire in a substantially parallel direction to at least one other row of the countermeasures.

17. The system of claim 1, wherein each row of the countermeasures comprises an elongated explosive charge disposed along the length of the TOW.

18. The system of claim 17, wherein each row of the countermeasures comprises an elongated mass disposed along the length of the row, each of the elongated masses configured to be ejected by at least one of the elongated explosive charges.

19. The system of claim 1, wherein each row of the countermeasures comprises a plurality of segmented explosive charges disposed along the length of the row.

20. The system of claim 19, wherein each row of the countermeasures comprises a plurality of masses disposed along the length of the row, each of the plurality of masses configured to be ejected by at least one of the explosive charges.

21. The system of claim 1, wherein the frame includes a plate with elongated recesses configured to accommodate the at least one of an elongated explosive charge or plurality of segmented explosive charges.

22. The system of claim 1, wherein the frame includes a plurality of ridges on a side opposite to the at least two rows of countermeasures, the plurality of ridges configured to engage with corresponding ridges on a vehicle when the countermeasure panel is mounted to the vehicle.

* * * * *